US005620398A

United States Patent [19]

Moriarty

[11] Patent Number: 5,620,398

[45] Date of Patent: Apr. 15, 1997

[54] EXERCISE APPARATUS FOR WRISTS AND FOREARMS

[76] Inventor: Eric P. Moriarty, 1749 Golf Rd., #138, Mt. Prospect, Ill. 60056

[21] Appl. No.: 631,305

[22] Filed: Apr. 10, 1996

[51] Int. Cl.[6] ..... A63B 23/14

[52] U.S. Cl. ..... 482/46

[58] Field of Search ..... 482/44, 45, 46, 482/92, 93, 94, 99, 100, 101, 102, 103, 129, 130, 139; 441/69

[56] References Cited

U.S. PATENT DOCUMENTS

| | | | |
|---|---|---|---|
| 3,079,885 | 3/1963 | Cooke | 441/69 |
| 3,174,702 | 3/1965 | French | 441/69 |
| 3,208,586 | 9/1965 | Wilson | 441/69 |
| 3,806,121 | 4/1974 | Crossley . | |
| 3,861,347 | 1/1975 | Christenson | 441/69 |
| 3,939,460 | 2/1976 | Beck | 441/69 |
| 4,392,833 | 7/1983 | Hayden | 441/69 |

*Primary Examiner*—Richard J. Apley
*Assistant Examiner*—William LaMarca
*Attorney, Agent, or Firm*—Donald A. Kettlestrings

[57] ABSTRACT

Wrists and forearms exercise apparatus for use with a free weight, or weights, includes a cylindrical bar defining a central location with handles attached to opposed ends of the bar. First and second spaced-apart holes located equidistant from the central location extend completely through the bar immediately adjacent to the ends of the bar, and an open-topped channel is defined within the bar and extends between the holes. A flexible cable is positioned within the channel and normally extends downwardly through the holes. The free weight, or weights, are connected to lower looped ends of the cable so that the weight, or weights, are suspended and centered beneath the bar. Because the weight, or weights, are suspended beneath the bar from two locations equidistant from the central location of the bar, movement of the weight, or weights, from side-to-side is limited as the handles and the bar are rotated during use. This enables the user to exert equal torques and forces with both wrists and both forearms during exercise so that symmetrical muscle development is achieved.

16 Claims, 2 Drawing Sheets

EXERCISE APPARATUS FOR WRISTS AND FOREARMS

BACKGROUND OF THE INVENTION

This invention relates to exercise apparatus and more particularly to wrists and forearms exercise apparatus for use with a free weight, or weights.

Various types of exercise devices are known for strengthening the wrists and forearms. For example, wrist rollers using a friction principle of resistance and wrist rollers using free weights are known. Such devices, however, have not proved entirely satisfactory for several reasons.

Wrist rollers using a friction principle of resistance do not require balancing the device, and disparities in the strength and size of the user's wrists and forearms are not resolved or challenged by use of the device because each arm and wrist is working independently. Existing wrist rollers using free weights suspended from a center attachment, as described in U.S. Pat. No. 3,806,121, permits the weight, or weights, to move and swing from side to side during use. This side to side movement of the weight creates a greater resistance or a smaller resistance on each wrist and forearm as the weight swings so that unequal forces and torques must be exerted by the wrists and forearms of the user as the device is rotated. This causes a corresponding disparity in development of the size, shape and strength of the muscles in the user's wrists and forearms.

It is, therefore, an object of the present invention to provide wrists and forearms exercise apparatus for use with a free weight, or weights.

Another object is to provide such an apparatus which suspends the weight, or weights, beneath the apparatus from a cable supported at locations equidistant from the center of the apparatus so the weight, or weights, will remain substantially centered beneath the apparatus during use.

A further object of the invention is the provision of such apparatus which contributes to the symmetry of size and strength of both wrists and both forearms muscle development.

Still another object is to provide such apparatus which provides a substantially equal resistance to each wrist and forearm of a user so as to require a substantially equal effort and torque by each wrist and forearm of the user.

Yet another object of the present invention is the provision of such apparatus which enables a user to symmetrically develop his or her wrists and forearms.

A still further object is the provision of such apparatus which enables the cable suspending the free weight, or weights, to be evenly and symmetrically wrapped around the bar of the apparatus during use without interference.

A further object of the invention is the provision of such apparatus which enables the cable suspending the weight, or weights, from the bar of the apparatus to be wrapped around the bar in an even and symmetrical fashion during use to provide evenness and symmetry of resistance for both wrists and both forearms of the user as the cable winds around the bar.

Another object is to provide such apparatus which enables balancing of free weights to contribute to the symmetry of size and strength of muscle development in the user's wrists and forearms.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects, the present invention provides wrists and forearms exercise apparatus for use with a weight, or weights, the apparatus comprising: a bar defining first and second opposed ends equidistance from a central location of the bar; the bar further defining first and second spaced-apart holes located equidistant from the central location and extending completely through the bar, and an open-topped channel extending between the holes; first and second handles respectively connected to the first and second ends; an elongated, flexible member positioned within the channel and normally extending downwardly through the holes; and means in operative relationship with the flexible member for removably connecting the weight, or weights, to the flexible member.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Figure 1:
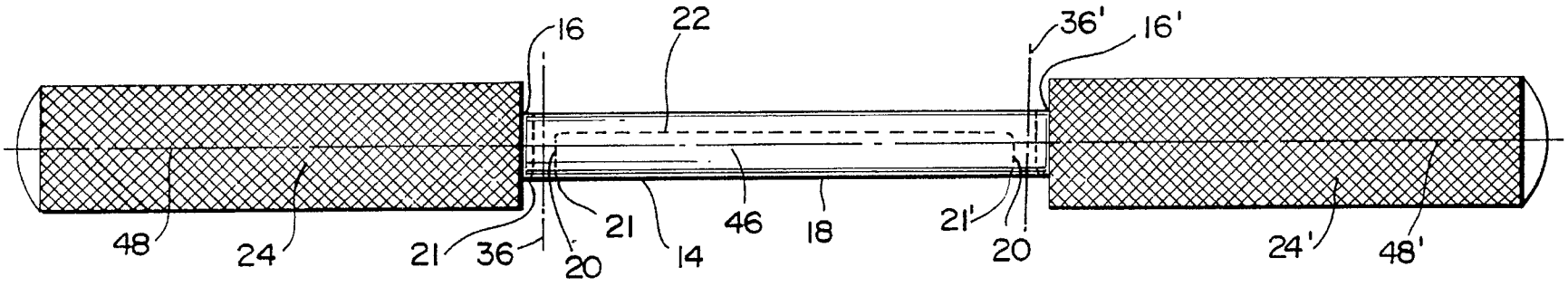
FIG. 1 is a front elevation view of the bar of the apparatus.
Figure 2:
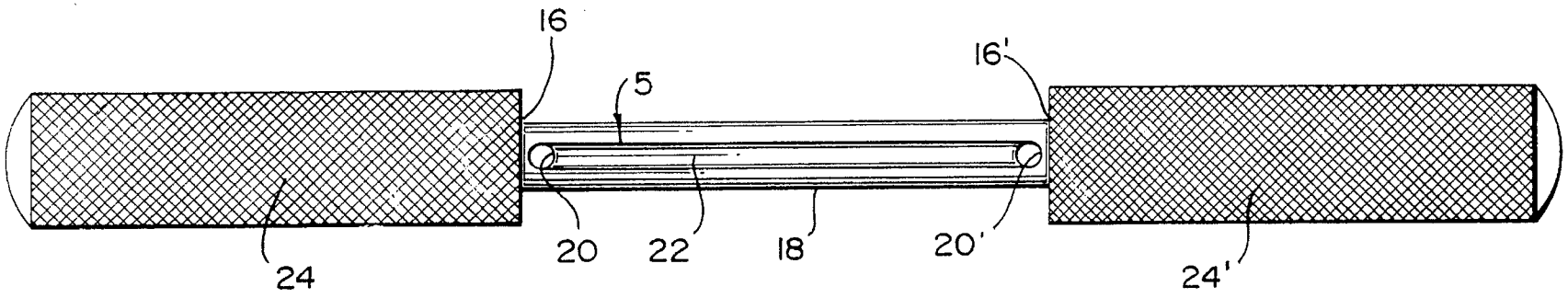
FIG. 2 is a top plan view of the bar.
Figure 3:
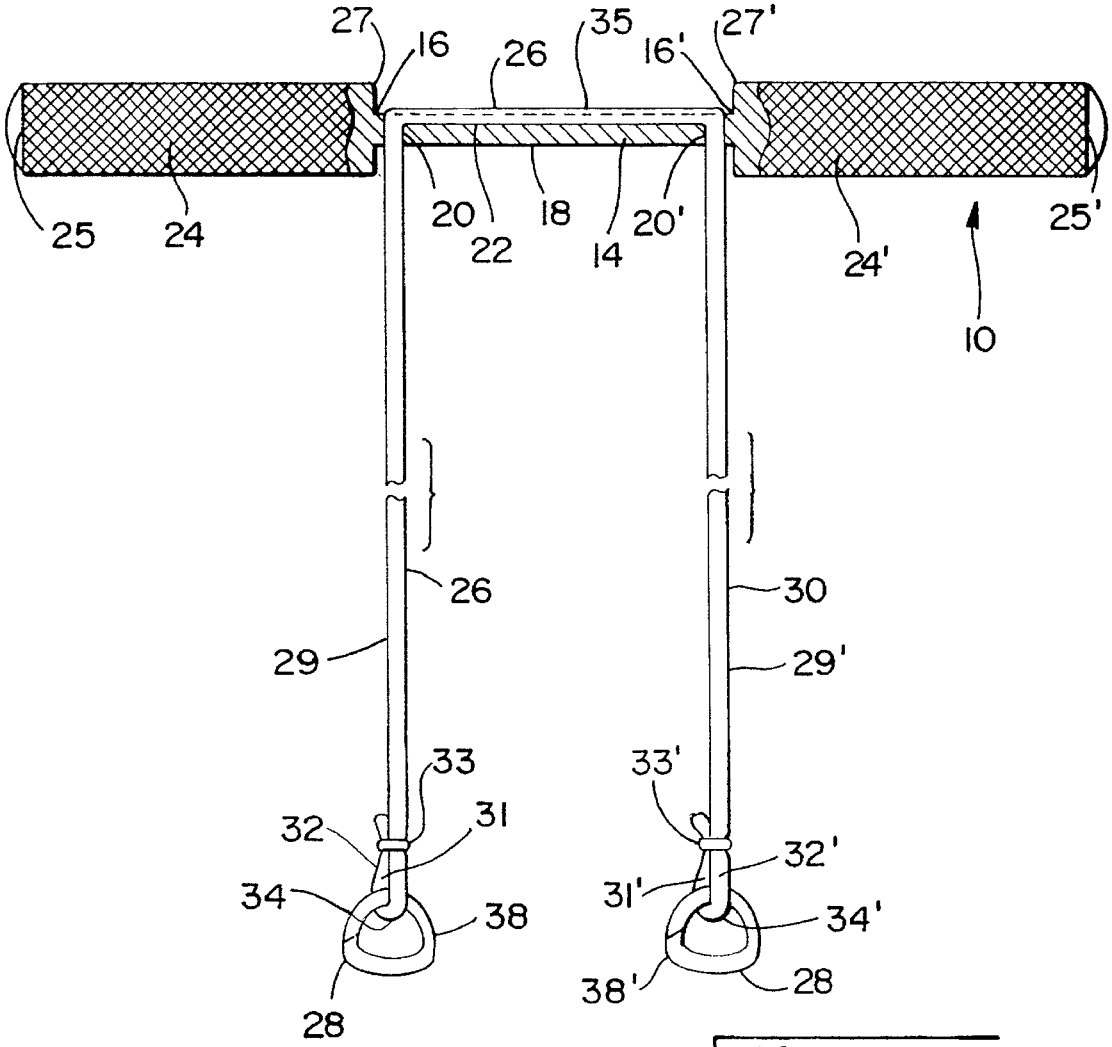
FIG. 3 is a front elevation view of the apparatus without the chain and weight or weights attached.
Figure 4:
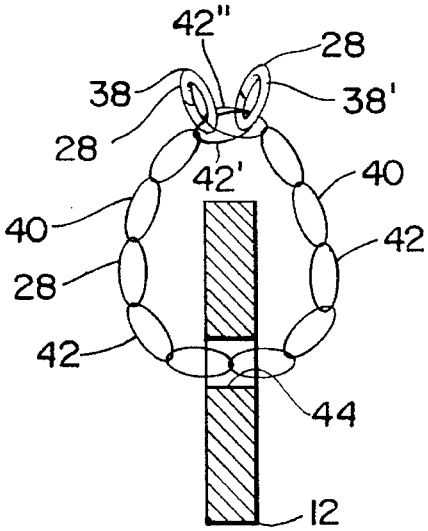
FIG. 4 is a partial front elevation view showing the chain and a weight attached to the chain as they are connected to the apparatus.

With reference now to the drawings, wherein like reference characters designate like or corresponding parts throughout the several views, there is shown wrists and forearms exercise apparatus 10 for use with a conventional weight, or weights, 12. In accordance with the invention, apparatus 10 includes a bar 14 defining first and second opposed ends 16, 16' equidistant from a central location 18 of bar 14. Bar 14 further defines first and second spaced-apart holes 20, 20' located equidistant from central location 18 and extending completely through bar 14. Holes 20, 20' define first and second longitudinal axes 36, 36', respectively, and axes 36, 36' are preferably parallel to each other. Bar 14 also defines an open-topped channel 22 which extends between holes 20, 20'.

Apparatus 10 further includes first and second handles 24, 24' respectively connected to first and second ends 16, 16' of bar 14. An elongated, flexible member 26 is positioned within channel 22 and normally extends downwardly through holes 20, 20'. Means, generally indicated at 28, are provided in operative relationship with flexible member 26 for removably connecting weight, or weights, 12 to flexible member 26.

The cross-sectional dimension of flexible member 26 is less than the diameter of each of holes 20, 20' so that flexible member 26 will slideably fit within and through the holes.

The cross-sectional dimension of flexible member 26 is also preferably less than or equal to the depth of channel 22 so that normally downwardly depending portions 29, 29' of flexible member 26 can be wrapped around bar 14 during use without interference and without "bumping" over the portion of flexible member 26 which is positioned within channel 22. Flexible member 26 is preferably a cable 30, and cable 30 defines first and second ends 32, 32' forming first and second loops 34, 34', respectively. Each of loops 34, 34' is preferably reinforced with conventional tear-drop shaped metal fittings 31, 31', respectively, and fittings 31, 31' are preferably held in place within loops 34, 34' by conventional ferrules 33, 33', respectively.

In accordance with a preferred embodiment of the invention, connecting means 28 include first and second conventional spring-loaded metal clips 38, 38' removably connected to loops 34, 34', respectively. Connecting means 28 further preferably includes a chain 40 formed by a flexible series of joined links 42. Weight, or weights, 12 defines an opening 44 therein of sufficient size to removably receive chain 40 therethrough. Weight, or weights, 12 is positioned on chain 40 by passing the chain through opening 44 of weight 12, and weight, or weights, 12 is held in position on chain 40 by removably attaching clips 38, 38' to links 42 of chain 40. Chain 40 defines end links 42', 42", and each of clips 38, 38' is typically attached to each end link 42', 42" of the chain.

Holes 20, 20' are preferably respectively located immediately adjacent to ends 16, 16' of bar 14, and bar 14 is preferably cylindrical defining a first predetermined diameter. Handles 24, 24' are also each preferably cylindrical defining a second predetermined diameter greater than the first predetermined diameter of bar 14.

Bar 14 defines a longitudinal axis 46 and handles 24, 24' each defines a longitudinal axis 48, 48', respectively. The longitudinal axis 46 of bar 14 and the longitudinal axes 48, 48' of handles 24, 24' are positioned in alignment with each other.

Longitudinal axes 36, 36' of holes 20, 20' preferably intersect longitudinal axis 46 of cylindrical bar 14 and holes 20, 20' each preferably defines a lower end countersunk portion 21, 21', respectively. The countersunk portions enable cable 30 to move relative to the lower ends of holes 20, 20' without causing undue friction and wear on the cable. Channel 22 preferably defines a rounded cross-section which will conform to the outer rounded configuration of cable 30.

Bar 14 and handles 24, 24' are preferably constructed from one and one-half inch diameter cold rolled steel. The overall length of bar 14 combined with handles 24, 24' is preferably twenty-two inches. Bar 14 is preferably ten inches in length and each of handles 24, 24' is preferably six inches long. The one and one-half inch diameter cold rolled steel is machined in three sections to form bar 14 and handles 24, 24'. The surfaces of handles 24, 24' are preferably knurled to provide a good gripping surface, and ends 25, 25' of the handles are rounded. The cross-sectional diameter of bar 14 is preferably three-quarters inch and holes 20, 20' are each preferably five-sixteenths inch in diameter. Axis 36 of hole 20 is preferably located five-sixteenths inch from interior end 27 of handle 24, and axis 36' of hole 20' is preferably located five-sixteenths inch from interior end 27' of handle 24'. Cable 30 is preferably a plastic coated steel cable having a length of ten feet six inches. It should be understood that the dimensions described are not limiting and that other dimensions could be used in accordance with the invention.

In operation and use, conventional weight, or weights, 12 are positioned with chain 40 extending through opening 44 in the weight, or weights, and end links 42', 42" of chain 40 are each connected to each of clips 38, 38' in a conventional manner. The heaviness of weight, or weights, 12 is determined by the strength of the user.

The user then grasps handles 24, 24', one handle in each hand. The manner of gripping is determined by the muscles to be exercised and strengthened and how those muscles are to be exercised and strengthened. For example, handles 24, 24' can be grasped in a palm-up position for one exercise, and the handles can be grasped in a palm-down manner for another exercise.

Apparatus 10 is then lifted by the user and held outwardly in front of the user. The user then applies alternating torques and gripping forces with each hand to handles 24, 24' which causes axial rotation of handles 24, 24' and bar 14. This, in turn causes depending portions 29, 29' of cable 30 to be wrapped around bar 14 and over portion 35 of cable 30 which is located within channel 22.

Because weight, or weights, 12 are suspended beneath central location 18 of bar 14 from holes 20, 20' equidistant from central location 18, depending portions 29, 29' of cable 30 will be symmetrically and evenly wrapped around bar 14 as bar 14 is turned and as the exercise continues. Weight, or weights, 12 will be raised upwardly toward bar 14 in a stable manner and weight, or weights, 12 will not have a tendency to swing from side to side during the exercise, as is the case with the weights in those devices which suspend the weights from only a central portion of the exercise apparatus. The wrists and forearms can also be exercised by similarly turning handles 24, 24' and bar 14 to lower weight, or weights, 12 after the weight has been raised, as previously described.

Weight, or weights, 12 will tend to remain substantially centered beneath central location 18 during the exercise process with the result that the user's wrists and forearms will be symmetrically exercised. The configuration of apparatus 10 provides a substantially equal resistance to each wrist and forearm of the user so as to require a substantially equal effort and torque by each wrist and forearm of the user during the exercise process.

The invention in its broader aspects is not limited to the specific details shown and described, and departures may be made from such details without departing from the principles of the invention and without sacrificing its chief advantages.

What is claimed is:

1. Wrists and forearms exercise apparatus comprising:

a substantially cylindrical bar defining a first predetermined diameter and first and second opposed ends equidistant from a central location of said bar;

first and second substantially cylindrical handles defining a second predetermined diameter greater than said first predetermined diameter and respectively connected to and extending outwardly from said first and second ends;

wherein each of said handles has a longitudinal length sufficient to enable a user to grasp each of said handles with a full hand;

said bar further defining first and second spaced apart holes located between said handles substantially equidistant from said central location and extending completely through said bar, and an open-topped channel extending between said holes;

an elongated, flexible member positioned within said channel and normally extending downwardly through said holes; and means in operative relationship with said flexible member for removably connecting a weight, or weights, to said flexible member.

2. Apparatus as in claim 1 wherein said flexible member defines a first cross-sectional dimension, said holes each define a first diameter and said channel defines a depth, and wherein said cross-sectional dimension is less than said first diameter and substantially equal to or less than said depth.

3. Apparatus as in claim 2 wherein said flexible member is a cable.

4. Apparatus as in claim 3 wherein said cable defines first and second ends forming first and second loops, respectively.

5. Apparatus as in claim 4 wherein said first and second holes define first and second longitudinal axes, respectively, and wherein said axes are substantially parallel to each other.

6. Apparatus as in claim 5 wherein said connecting means include first and second clips removably connected to said first and second loops, respectively.

7. Apparatus as in claim 6 wherein said connecting means further include a chain formed by a flexible series of joined links.

8. Apparatus as in claim 7 in combination with said weight or weights, wherein said weight, or weights, each defines an opening therein of a size to removably receive said chain therethrough, and wherein said weight, or weights, is positioned on said chain by passing said chain through said opening of said weight, or weights, and wherein said weight, or weights, is held in position on said chain by removably attaching said clips to said chain.

9. Apparatus as in claim 7 wherein said first and second holes are respectively located immediately adjacent to said first and second ends of said bar.

10. Apparatus as in claim 1 wherein said cylindrical bar defines a longitudinal axis and said cylindrical handles each defines a longitudinal axis and wherein said bar's longitudinal axis and said handles' longitudinal axes are positioned in substantial alignment with each other.

11. Apparatus as in claim 10 wherein said first and second holes define first and second longitudinal axes, respectively, and wherein said first and second longitudinal axes are substantially parallel to each other.

12. Apparatus as in claim 11 wherein said first and second longitudinal axes intersect said longitudinal axis of said cylindrical bar.

13. Apparatus as in claim 12 wherein each of said first and second holes defines a lower end countersunk portion.

14. Apparatus as in claim 13 wherein said channel defines a substantially rounded cross-section.

15. Apparatus as in claim 14 wherein said first and second holes are respectively located immediately adjacent to said first and second ends of said bar.

16. Apparatus as in claim 1 wherein said first and second holes are respectively located immediately adjacent to said first and second ends of said bar.

* * * * *